US008556440B2

(12) United States Patent
Hong

(10) Patent No.: US 8,556,440 B2
(45) Date of Patent: Oct. 15, 2013

(54) REFRIGERATOR

(75) Inventor: Chunhee Hong, Gyeongnam (KR)

(73) Assignee: LG Electronics Inc., Seoul (KR)

( * ) Notice: Subject to any disclaimer, the term of this patent is extended or adjusted under 35 U.S.C. 154(b) by 205 days.

(21) Appl. No.: 13/184,201

(22) Filed: Jul. 15, 2011

(65) Prior Publication Data

US 2012/0014090 A1 Jan. 19, 2012

(30) Foreign Application Priority Data

Jul. 16, 2010 (KR) ..... 10-2010-0068934

(51) Int. Cl.
*F25D 27/00* (2006.01)
*F27D 21/02* (2006.01)

(52) U.S. Cl.
USPC ..... 362/94; 62/264

(58) Field of Classification Search
USPC ..... 362/92–94; 62/259.1, 264
See application file for complete search history.

(56) References Cited

U.S. PATENT DOCUMENTS

| | | | | |
|---|---|---|---|---|
| 4,706,169 | A | 11/1987 | Bussan et al. | |
| 5,701,235 | A | 12/1997 | Hagemeyer et al. | |
| 6,880,949 | B2 * | 4/2005 | Miozza et al. | 362/92 |
| 6,923,015 | B2 * | 8/2005 | Ueno et al. | 62/264 |
| 7,736,010 | B2 * | 6/2010 | Lee | 362/92 |
| 8,037,706 | B2 | 10/2011 | Görz et al. | |
| 2007/0157638 | A1 | 7/2007 | Wetekamp | |
| 2009/0133425 | A1 | 5/2009 | Goerz et al. | |

FOREIGN PATENT DOCUMENTS

| | | | |
|---|---|---|---|
| CN | 1435663 | A | 8/2003 |
| CN | 200940989 | Y | 8/2007 |
| DE | 102005057142 | A1 | 6/2007 |
| JP | 2010-078251 | A | 4/2010 |

OTHER PUBLICATIONS

European Search Report for Application No. 11173911, dated Feb. 16, 2012, 6 pages.
Chinese Office Action dated Jul. 3, 2013 for Application No. 201110243424.7, with English Translation, 18 pages.

* cited by examiner

*Primary Examiner* — Jason Moon Han
(74) *Attorney, Agent, or Firm* — Fish & Richardson P.C.

(57) ABSTRACT

The present invention relates to a refrigerator, and more particularly, to a refrigerator can display state information on a storage space, direct a light to an inside of the storage space when the door is opened, requires no additional lighting enabling to utilize a storage space to the maximum and to produce a high quality appearance.

10 Claims, 3 Drawing Sheets

REFRIGERATOR

CROSS REFERENCE TO RELATED APPLICATION

Pursuant to 35 U.S.C. §119(a), this application claims the benefit of the Patent Korean Application No. 10-2010-0068934 filed on Jul. 16, 2010, which is hereby incorporated by reference as if fully set forth herein.

BACKGROUND OF THE DISCLOSURE

1. Field of the Disclosure

The present invention relates to a refrigerator for low temperature storage of food.

2. Discussion of the Related Art

In general, the refrigerator is a domestic appliance for low temperature storage of food for fresh and long time storage thereof, wherein a cold air state is controlled according to states of food for frozen or refrigerated storage of the food.

The cold air supplied to the refrigerator is produced by heat exchange of refrigerant in repetitive compression-condensing-expansion-evaporation cycles, and the cold air supplied thus is provided to an inside of the refrigerator uniformly by convection enabling to store the food at a desired temperature.

Depending on a configuration of a freezing chamber and a refrigerating chamber, in the refrigerators, there are general type refrigerators, side by side door type refrigerators, bottom freezer type refrigerators, and so on.

The general type refrigerator has a freezing chamber on an upper side of the refrigerator, and a refrigerating chamber on a lower side of the refrigerator, the side by side door type refrigerator has the freezing chamber and the refrigerating chamber arranged side by side in a left to right direction.

The bottom freezer type refrigerator is a type currently used in the U.S.A. and the Europe mostly, and has the refrigerating chamber greater than the freezing chamber positioned on the upper side while the freezing chamber is positioned on the lower side.

In the meantime, the refrigerator is provided with a body having at least one storage space for low temperature storage of food and a door rotatably mounted to the body for selective opening/closing of the storage space.

The body has a structure in which a heat insulating material is stuffed in a space between an outer case and an inner case of refrigerator for heat insulation of the space for refrigerated or frozen storage of food from an outside of the refrigerator, wherein a plurality of shelves are mounted on an inside of the inner case for enhancing space utilization.

In the meantime, currently, for convenience of use of the refrigerator, various functions are added to the refrigerator. In order to embody such functions, a home bar is or a plurality of baskets are provided to a back side of the door for convenient storage of a certain amount of food or food containers therein.

And, a display unit is provided on an outside of the door for displaying state information on the various storage spaces.

However, in a case the display unit is provided to the outside of the door, the refrigerator has problems in that, not only direct determination of a state of the storage space in a door open state at the same time with determination of state information displayed on the display unit is difficult, but also production of various outer appearances is difficult due to the display unit occupying a certain area of the outside of the door.

SUMMARY OF THE DISCLOSURE

Accordingly, the present invention is directed to a refrigerator.

An object of the present invention is to provide a refrigerator which includes a display unit which can display state information on a storage space and direct a light to an inside of the storage space when the door is opened.

Another object of the present invention is to provide a refrigerator which requires no additional lighting enabling to utilize a storage space to the maximum and to produce a high quality appearance.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerator includes a body including at least one storage space, at least one door mounted to the body for selective opening/closing of the storage space, and a display unit including a display portion mounted in the storage space to be exposed to a front side of the refrigerator when the door is opened for displaying state information on the storage space, and a light emitting unit positioned in rear of the display portion.

And, the display unit can include a housing including a front side with the display portion provided thereto and a rear side for emitting a light toward the storage space, at least one light source arranged on a rear side of the housing, a control unit for controlling the state information and operation of a light source, and a mounting portion for mounting the housing in the storage space.

And, the rear side of the housing is a sloped side sloped at a predetermined angle from the front side of the housing.

And, the housing can be mounted to a top side of the storage space, and the rear side of the housing can be sloped such that a distance between the front side and the rear side becomes the smaller as the rear side goes toward a lower side of the housing the more.

And, the rear side of the housing can have a diffusing portion provided thereto.

And, the light source can be a light emitting diode.

And, the mounting portion can be provided in the housing, and can be at least one boss extended toward an inner circumferential surface of the storage space.

And, the housing can have an opening in a front thereof and the display portion can be placed in, and coupled to, the front of the housing such that the display portion is matched to the opening.

And, the display portion can display at least one of an operation mode, an operation temperature, door opening, door lock setting, and an abnormal state.

And, the display unit can include an operation unit provided to one side of the display portion.

In another aspect of the present invention, a refrigerator includes a body including a storage space, a door mounted to the body for selective opening/closing of the storage space, and a display unit having a display portion mounted in the storage space for displaying state information on the storage space, and lighting the storage space.

And, the display unit can include a housing having a first side for displaying the state information thereon and a second side for emitting a light toward the storage space, a display portion mounted in the housing for displaying the state information on the first side, a light emitting module mounted in the housing for providing lighting through the second side, and a control unit for controlling the display portion and the light emitting module.

And, the light emitting module can include a substrate, a plurality of light emitting diodes mounted to the substrate, and a diffusing portion for passing the light from the light emitting diodes.

And, the second side of the housing can be a sloped side sloped at a predetermined angle from the first side.

And, the display unit can include an operation unit provided to the first side of the housing.

It is to be understood that both the foregoing general description and the following detailed description of the present invention are exemplary and explanatory and are intended to provide further explanation of the invention as claimed.

BRIEF DESCRIPTION OF THE DRAWINGS

The above and other aspects, features, and advantages of the present invention will become more apparent upon consideration of the following description of preferred embodiments, taken in conjunction with the accompanying drawing figures.

DESCRIPTION OF SPECIFIC EMBODIMENTS

Figure 1:
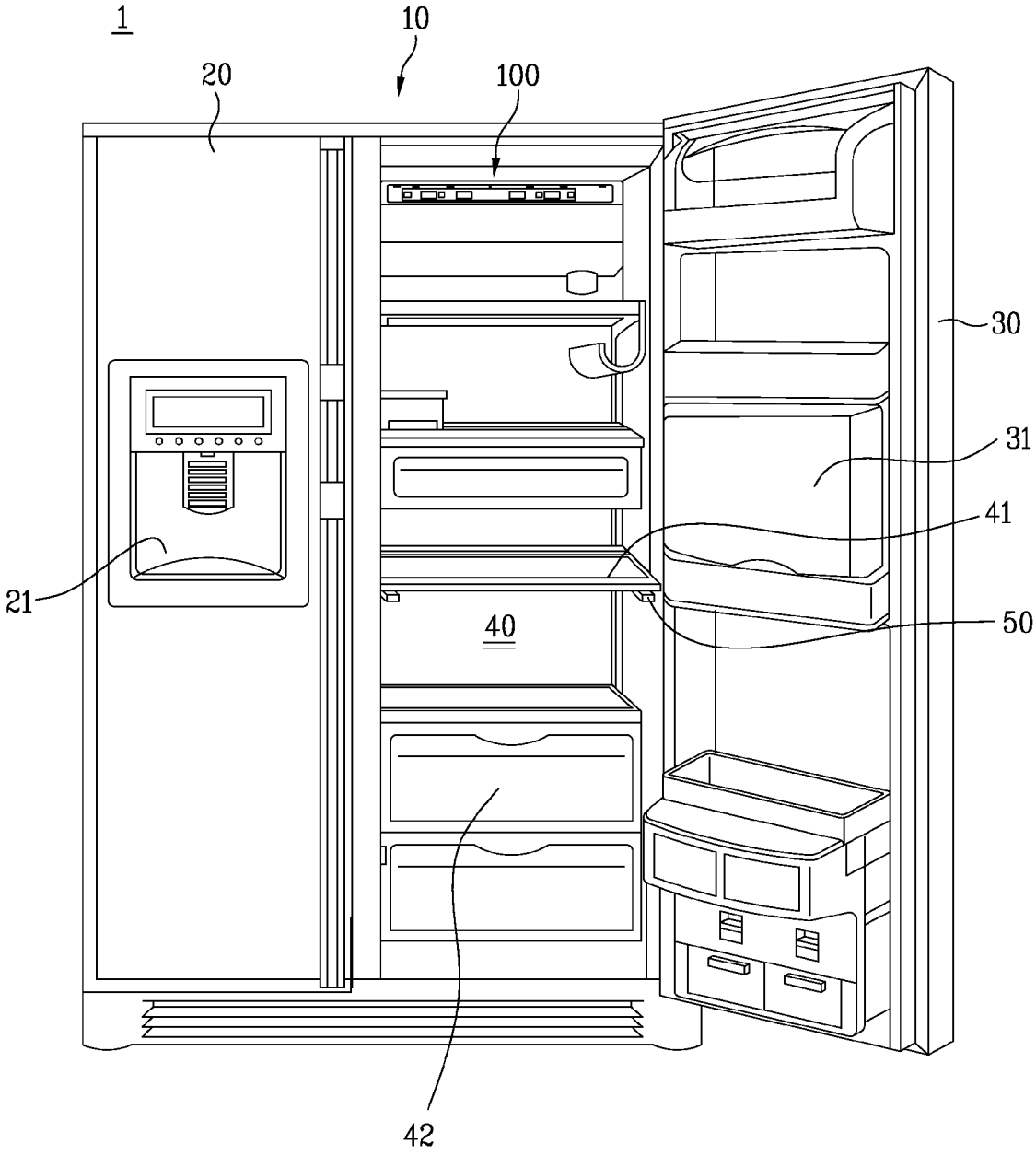
FIG. 1 illustrates a perspective view of a refrigerator in accordance with a preferred embodiment of the present invention, showing a state in which one of doors is opened.

In the following detailed description, reference is made to the accompanying drawing figures which form a part hereof, and which show by way of illustration of specific embodiments of the invention. It is to be understood by those of ordinary skill in this technological field that other embodiments may be utilized, and structural, electrical, as well as procedural changes may be made without departing from the scope of the present invention. Wherever possible, the same reference numbers will be used throughout the drawings to refer to the same or similar parts.

A refrigerator in accordance with a preferred embodiment of the present invention will be described with reference to the attached drawings. The attached drawings are illustrative, and only provided for describing the present invention in more detail, but do not limit technical scopes of the present invention.

And, identical or equivalent elements will be given the same reference numerals regardless of drawing numbers, repetitive description thereof will be omitted, and for convenience of description, sizes and shapes of the elements can be exaggerated or reduced.

Though terms including ordinal numbers, such as first or second, can be used for describing various elements, the elements are not limited by the terms, and are used only for making one element distinctive from other elements.

FIG. 1 illustrates a perspective view of a refrigerator in accordance with a preferred embodiment of the present invention, showing a state in which one of doors is opened.

Though a refrigerator 1 in accordance with a preferred embodiment of the present invention is applicable to all refrigerators of various types (For an example, a general type, a side by side type, or a bottom freezer type), in detail, to all refrigerators each including at least a body for low temperature storage, and a door rotatably mounted to the body for selective opening/closing of the storage space, the refrigerator 1 will be described taking the side by side door type refrigerator having a freezing chamber and a refrigerating chamber positioned side by side in a left to right direction to be opened/closed by respective doors selectively as an example.

The refrigerator in accordance with a preferred embodiment of the present invention includes a body 10 having at least one storage space 40 for low temperature storage, a door 30 rotatably mounted to the body 10 for selective opening/closing of the storage space 40.

Referring to FIG. 1, the refrigerator 1 in accordance with a preferred embodiment of the present invention includes a body 10 which provides a space 40 for storage of food and food containers at a low temperature and providing an exterior of the refrigerator, wherein the body 10 has a hexahedral shape substantially, with an opened front for placing the food and the food containers therein, and includes an outer case (Not shown) and at least one inner case (Not shown) in the outer case for providing the storage space for refrigerated or frozen storage of the food.

The door is rotatably mounted to the opened front of the body 10 for selective opening/closing of the opened front of the body 10. Though FIG. 1 illustrates a side by side door type refrigerator, a case is illustrated, in which a first door 20 and a second door 30 are mounted to the body 10 for opening/closing a left side storage space and a right side storage space, respectively.

And, currently, for convenience of use of the refrigerator, various functions are added to the refrigerator, and in order to embody such functions, the refrigerator can further include a dispenser 21 provided to the door 20 or 30 for dispensing purified water or ice to an outside of the refrigerator directly, and a home bar 31 for placing or storage of a certain amount of food or food containers therein, conveniently.

And, the body 10 has an inside space partitioned into the left side space and the right side space, wherein, in general, the left side space serves as a freezing chamber (Not shown) for holding the food or the food container at a sub-zero temperature, and the right side space serves as a refrigerating chamber 40 for holding the food or the food contained at a temperature higher than zero degree.

The freezing chamber is used for long time storage of the food by freezing the food at a sub-zero temperature, and the refrigerating chamber 40 is maintained at a temperature lower than a room temperature for fresh storage of the food.

The freezing chamber and the refrigerating chamber 40 have a plurality of shelves 41 provided to inside spaces thereof for placing the food or the food container thereon, thereby partitioning the inside spaces of the freezing chamber and refrigerating chamber 40 into a plurality of tiers. And, the freezing chamber and the refrigerating chamber 40 can have drawers 42 for holding food, such as vegetable and fruits.

Figure 2:
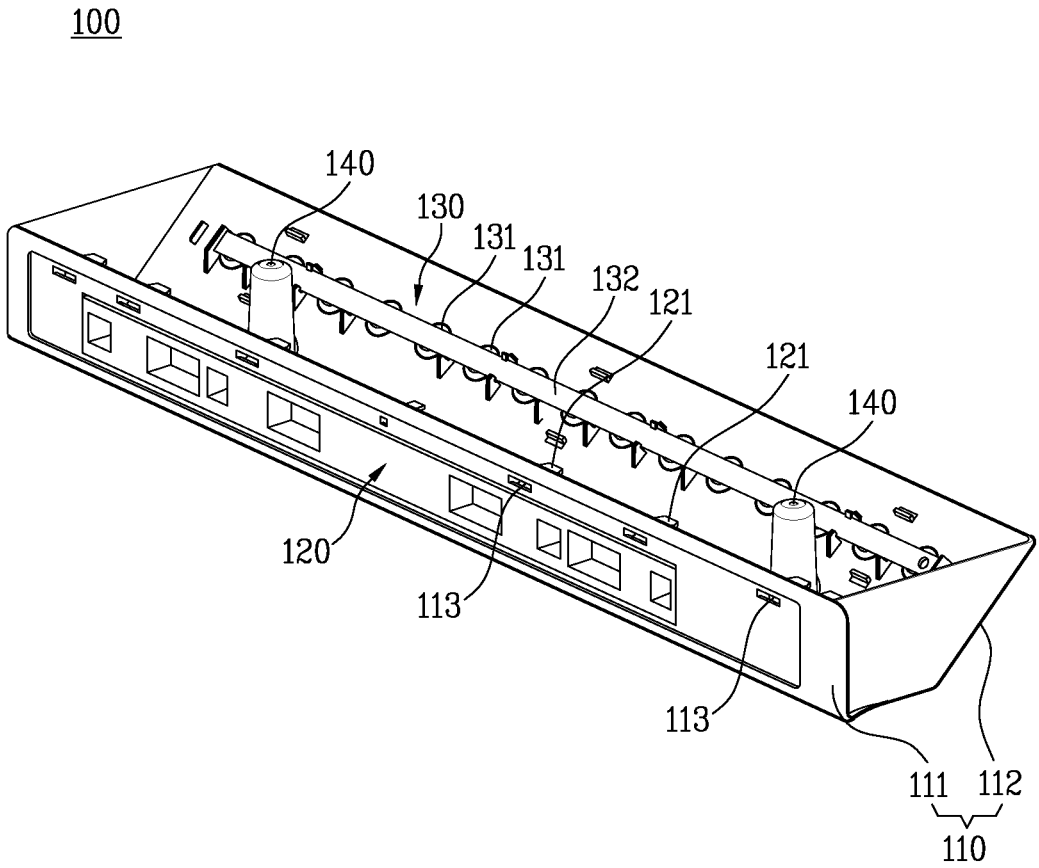
FIG. 2 illustrates a perspective view of a display unit separated from a refrigerator in accordance with a preferred embodiment of the present invention.
Figure 3:
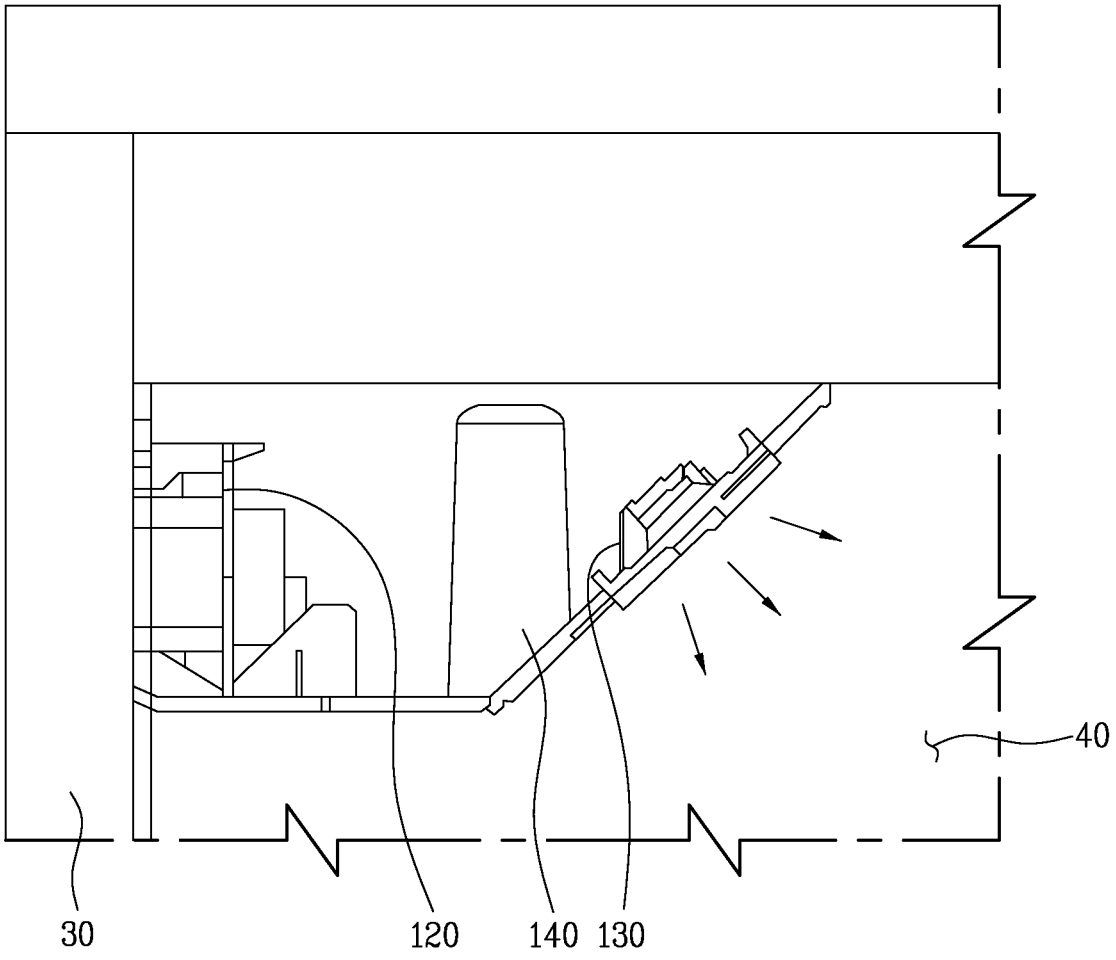
FIG. 3 illustrates a section of key parts of the display unit in FIG. 2 for describing a mounted state thereof.

FIG. 2 illustrates a perspective view of a display unit separated from a refrigerator in accordance with a preferred embodiment of the present invention, and FIG. 3 illustrates a section of key parts of the display unit in FIG. 2 for describing a mounted state thereof.

Referring to FIGS. 2 and 3, the display unit 100 includes the display portion 120 mounted in the storage space to be exposed to a front side of the refrigerator for displaying state information on the storage space when the door 30 is opened, and a light emitting unit 130 positioned in rear of the display portion.

In detail, when the door is opened, the display unit 100 displays state information on the storage space, and, at the same time with this, provides lighting to the storage space.

And, the display unit 100 can include a housing 110 having a first side 111 for displaying the state information, and a second side 112 for emitting a light toward the storage space, the display portion 120 arranged in the housing 110 for displaying the state information through the first side 111, a light emitting module 130 (the light emitting unit) provided in the housing 110 for providing lighting through the second side 112, and a control unit for controlling the display portion 120 and the light emitting module 130, wherein the first side and the second side of the housing can be a front side and a rear side of the housing, and, if design characteristics of the housing and the storage space are taken into account, the first side can be the front side and the second side can be any one side.

In this instance, the storage space can be any one of the freezing chamber and the refrigerating chamber 40, and the display unit 100 can be mounted to both of the freezing chamber and the refrigerating chamber 40, or any one of the freezing chamber and the refrigerating chamber 40. In the meantime, if the display unit 100 is mounted only one of the freezing chamber and the refrigerating chamber 40, the display unit 100 can display the state information on the storage space having no display unit mounted thereto, undoubtedly.

The embodiment will be described with reference to FIGS. 2 and 3, taking a case in which the display unit 100 is mounted to the refrigerating chamber 40 as an example.

The state information on the storage space 40 can include at least one of an operation mode, an operation temperature, door opening, door lock setting, and an abnormal state of the storage space 40.

In detail, the display portion 120 can display, not only the operation temperature of the freezing chamber, and the operation temperature of the refrigerating chamber, but also the operation temperature of a storage space of food which requires special care (For an example, a grain storage box, or a vegetable storage box).

And, the display unit 100 can display abnormal state information which warns door opening or abnormal operation of the refrigerator, by displaying a numeral or an icon of the abnormal state given in advance, or flashing a warning lamp, or issuing a recorded voice.

And, the display unit 100 can include an operation unit (Not shown) provided to one side of the display portion 120.

The operation unit can include a refrigerating chamber temperature control unit, a freezing chamber temperature control unit, and a temperature control unit for the special storage space, and can include an operation mode selecting unit and a lock setting/unlock input unit. And, the operation unit can be of a touch pad type, or a button press type or a button rotation type.

The display unit 100 can include a housing 110 having a first side 111 with a display portion 120 provided thereto, and a second side 112 for emitting a light toward an inside of the storage space 40, at least one light source 131 arranged on a rear side of the housing 110, a control unit (Not shown) for controlling operation of the state information and the light source 131, and a mounting portion 140 for mounting the housing in the storage space.

The display portion 120 can be a liquid crystal display or an array of light emitting diodes for displaying numerals, characters, and various codes.

The display portion 120 can be a module or an assembly having a front cover exposed to a front side of the refrigerator when the door is opened, and a substrate (Not shown) mounted to the front cover, and the control unit can be mounted to the substrate.

And, the housing 110 can have an opening (Not shown) in the front side 111, and the display portion 120 can be placed in the front side of the housing such that the display portion 120 is matched to the opening.

In this instance, the front cover of the display portion 120 can have at least one hook 121 provided to an edge thereof, and the front side 111 of the housing 110 can have an eye 113 at a position matched to the hook 121, or vice versa.

Accordingly, the refrigerator 1 in accordance with a preferred embodiment of the present invention can make easy assembly and improve man-hours since the display portion 120 can be mounted to the front side 111 of the housing 110 of the display unit 100 as a module.

In the meantime, the rear side 112 of the housing 110 can be a sloped side sloped at a predetermined angle from the front side 111.

That is, for convenience of the user, it is preferable that the display portion 120 is exposed to the front side 111 of the housing 110 when the door is opened, and it is preferable that the light emitting unit 130 is arranged on the sloped side 112 for uniform lighting of the inside of the storage space.

And, the light emitting unit or the light emitting module 130 can include a substrate 132, a plurality of light emitting diodes 131 mounted to the substrate 132, and a diffusing portion through which the light from the light emitting diodes 131 passes. The light emitting diodes 131 can be arranged at fixed intervals.

For an example, if the front side of the housing 110 is arranged parallel to the rear side of the door in a door 30 closed state, the rear side 112 of the housing 110 can be sloped at an angle of 15° to 60° from the front side 111, or, different from this, the rear side 111 can be sloped from the front side, vertically. That is, the rear side 112 of the housing 110 can be sloped at an optimum angle for making uniform lighting of an entire space taking a volume and a structure of the storage space into account, undoubtedly.

Though the display unit 100 can be mounted to one side of the storage space, i.e., different positions, taking an exterior appearance of the refrigerator when the door 30 is opened into account, it is preferable that the display unit 100 is mounted to a top side of the storage space for preventing the display unit 100 from being damaged, contaminated, or shaded by the food or the food container stored thus.

And, referring to FIGS. 2 and 3, if the display unit 100 is mounted to the top side of the storage space, the rear side 112 of the housing 110 can be sloped such that a distance between the front side 111 and the rear side 112 of the housing 110 becomes the smaller as the rear side 112 of the housing 110 goes toward a lower side of the housing 110, the more.

By arranging the light emitting unit 130 on the sloped side of the housing 110, the uniform lighting of the storage space can be made.

And, the housing 110 can have a diffusing portion (Not shown) at the rear side thereof for making the light from the light source to diverge uniformly, and the light source 131 can be light emitting diodes. The light emitting diodes can reduce power consumption as the light emitting diode has low power consumption and a long lifetime.

In the meantime, referring to FIGS. 2 and 3, the mounting portion 140 can be at least one boss provided to an inside of the housing 110 extended toward an inside circumferential surface of the storage space 40.

Accordingly, at the time of mounting the housing 110, since a fastening member (For an example, a screw) is fastened to the inside circumference of the storage space passed through the inside of the housing 110, a neat and tidy exterior can be produced.

As has been described, the refrigerator of the present invention has the following advantages.

State information on a storage space can be displayed and an inside of the storage space can be lighted when the door is opened.

And, since no additional lighting is required, a storage space can be utilized to the maximum and a high quality appearance can be produced.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and appended claims. In addition to variations and modifications in the component parts and/or arrangements, alternative uses will also be apparent to those skilled in the art.

What is claimed is:

1. A refrigerator comprising:

a body including at least one storage space;

at least one door mounted to the body for selective opening/closing of the storage space; and a display unit including a display portion mounted in the storage space to be exposed to a front side of the refrigerator when the door is opened for displaying state information on the storage space, and a light emitting unit positioned in rear of the display portion, wherein the display unit includes:

a housing having a front side with the display portion provided thereto and a rear side for emitting a light toward the storage space, the housing being mounted to a top side of the storage space, a control unit for controlling the state information and operation of at least one light source, and a mounting portion for mounting the housing in the storage space, and wherein the light emitting unit includes the at least one light source provided at the rear side of the housing, wherein the rear side of the housing is sloped at a predetermined angle such that a distance between the front side and the rear side becomes smaller as the rear side goes toward a lower side of the housing more, so that the at least one light source emits light toward the storage space rearward and downward.

2. The refrigerator as claimed in claim 1, wherein the rear side of the housing has a diffusing portion provided thereto.

3. The refrigerator as claimed in claim 1, wherein the light source is a light emitting diode.

4. The refrigerator as claimed in claim 1, wherein the mounting portion is provided in the housing, and is at least one boss extended toward an inner circumferential surface of the storage space.

5. The refrigerator as claimed in claim 1, wherein the housing has an opening in a front thereof and the display portion is placed in, and coupled to, the front of the housing such that the display portion is matched to the opening.

6. The refrigerator as claimed in claim 1, wherein the display portion displays at least one of an operation mode, an operation temperature, door opening, door lock setting, and an abnormal state.

7. The refrigerator as claimed in claim 1, wherein the display unit includes an operation unit provided to one side of the display portion.

8. A refrigerator comprising:

a body having a storage space;

a door rotatably mounted to the body for selective opening/closing of the storage space; and a display unit mounted in the storage space for displaying state information on the storage space, and lighting the storage space, wherein the display unit includes:

a housing having a first side for displaying the state information thereon and a second side for emitting a light toward the storage space, the housing being mounted to a top side of the storage space, a display portion mounted in the housing for displaying the state information on the first side, a light emitting module mounted in the housing for providing lighting through the second side, and a control unit for controlling the display portion and the light emitting module, and wherein the second side of the housing is sloped at a predetermined angle such that a distance between the first side and the second side becomes smaller as the second side goes toward a lower side of the housing more, so that the light emitting module emits light toward the storage space rearward and downward.

9. The refrigerator as claimed in claim 8, wherein the light emitting module includes;

a substrate, a plurality of light emitting diodes mounted to the substrate, and a diffusing portion for passing the light from the light emitting diodes.

10. The refrigerator as claimed in claim 8, wherein the display unit includes an operation unit provided to the first side of the housing.

* * * * *